US009448510B2

(12) United States Patent
Izumi et al.

(10) Patent No.: US 9,448,510 B2
(45) Date of Patent: Sep. 20, 2016

(54) IMAGE FORMING APPARATUS FOR FORMING IMAGE BY USING DEVELOPER INCLUDING TONER AND CARRIER

(71) Applicant: KYOCERA Document Solutions Inc., Osaka-shi, Osaka (JP)

(72) Inventors: Koji Izumi, Osaka (JP); Hiroyoshi Omura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/806,536

(22) Filed: Jul. 22, 2015

(65) Prior Publication Data

US 2016/0033904 A1 Feb. 4, 2016

(30) Foreign Application Priority Data

Jul. 30, 2014 (JP) ..... 2014-155583

(51) Int. Cl.

| | |
|---|---|
| ***G03G 21/12*** | (2006.01) |
| ***G03G 21/00*** | (2006.01) |
| ***G03G 15/08*** | (2006.01) |
| ***G03G 21/10*** | (2006.01) |

(52) U.S. Cl.

CPC ..... *G03G 15/0891* (2013.01); *G03G 21/0005* (2013.01); *G03G 21/105* (2013.01); *G03G 21/12* (2013.01)

(58) Field of Classification Search

CPC ..... G03G 15/0891; G03G 21/0005; G03G 21/10; G03G 21/105; G03G 2221/1624

USPC ..... 399/360, 358, 359

See application file for complete search history.

(56) References Cited

U.S. PATENT DOCUMENTS

| | | | | |
|---|---|---|---|---|
| 6,795,668 | B1 * | 9/2004 | Nishiwaki | G03G 15/757 399/120 |
| 2008/0240757 | A1 * | 10/2008 | Suzuki | G03G 15/0808 399/53 |
| 2014/0010579 | A1 * | 1/2014 | Yoshino | G03G 21/105 399/358 |

FOREIGN PATENT DOCUMENTS

| | | | |
|---|---|---|---|
| JP | 63023181 A | * | 1/1988 |
| JP | 09212053 A | | 8/1997 |

* cited by examiner

*Primary Examiner* — Billy Lactaoen

(74) *Attorney, Agent, or Firm* — Alleman Hall McCoy Russell & Tuttle LLP

(57) ABSTRACT

An image forming apparatus includes an image carrier, a first guide portion, a developing portion, and a second guide portion. The first guide portion forms a first flow path in which toner removed from the image carrier is flowed downward with respect to a horizontal direction. The developing portion visualizes an electrostatic latent image formed on a surface of the image carrier, with developer including at least toner and carrier. The second guide portion forms a second flow path in which the developer in the developing portion is flowed diagonally downward with respect to the horizontal direction and guided to the first flow path.

3 Claims, 10 Drawing Sheets

FIG. 9

| INCLINATION ANGLE | 20 | 30 | 40 | 50 | 60 | 70 | 80 | 90 |
|---|---|---|---|---|---|---|---|---|
| PRESENCE/ABSENCE OF DESIGN PROBLEM | ○ | ○ | ○ | ○ | ○ | ○ | ○ | × |
| CLOGGING STATE OF WASTE TONER | × | × | △ | ○ | ○ | ○ | ◎ | – |

IMAGE FORMING APPARATUS FOR FORMING IMAGE BY USING DEVELOPER INCLUDING TONER AND CARRIER

INCORPORATION BY REFERENCE

This application is based upon and claims the benefit of priority from the corresponding Japanese Patent Application No. 2014-155583 filed on Jul. 30, 2014, the entire contents of which are incorporated herein by reference.

BACKGROUND

The present disclosure relates to an electrophotographic image forming apparatus for forming an image by using toner.

In an image forming apparatus, generally, an electrostatic latent image formed on an image carrier such as a photoconductor drum is visualized with toner in the developing device, and the toner image is transferred to a recording medium. At this time, some toner may not be transferred to the recording medium and remain on the surface of the image carrier. As a result, the residual toner is removed from the surface of the image carrier by a cleaning device.

The residual toner removed from the surface of the image carrier is collected, as waste toner, in a waste toner collection container. The waste toner may be conveyed in the following manner before it reaches the waste toner collection container.

The waste toner removed from the surface of the image carrier is conveyed to a predetermined position in the horizontal direction by a first screw. The predetermined position is connected with a waste toner pipe that extends downward, and when the waste toner reaches the predetermined position, the waste toner falls downward in the waste toner pipe. The lower end portion of the waste toner pipe is connected with a conveyance pipe which extends in the horizontal direction and in which a second screw is provided. The waste toner that has entered the conveyance pipe is conveyed in the conveyance pipe by the second screw, and is discharged to a waste toner collection container that is provided at a predetermined position of the conveyance pipe.

In the conveyance configuration as such, the waste toner may clog a connection part of the conveyance pipe and the waste toner pipe. The following may be one of the causes of the clogging.

Since the waste toner has low fluidity, the waste toner is likely to stick to an inner wall of the pipe. Once waste toner sticks to the inner wall, part of newly fallen waste toner sticks to the waste toner that has stuck to the inner wall. This goes on and on and results in a relatively large accumulation of waste toner. Such a large accumulation would clog the connection part.

In addition, there may be a case where the waste toner that is present in the conveyance pipe becomes bulky. In that case, the waste toner that has fallen in the waste toner pipe may accumulate on the waste toner that is present in the conveyance pipe, and the accumulation of the waste toner may reach the inside of the waste toner pipe and the waste toner may stick to the inner wall of the waste toner pipe. This allows accumulation of waste toner to be generated in the connection part of the conveyance pipe and the waste toner pipe. The accumulation causes a clog in the connection part.

If the pipe diameter of the conveyance pipe is made larger, the waste toner present in the conveyance pipe will become less bulky, and the waste toner in the conveyance pipe will not or rarely reach the inside of the waste toner pipe. In that way, the generation of the accumulation at the connection part will be prevented, and the clog of the waste toner will be prevented or restricted. However, in view of the demand for the miniaturization of the image forming apparatus in recent years, the method is not preferable since the apparatus will be larger in size if the pipe diameter is made larger, which is against the demand for the miniturization.

There is known a configuration for solving the above-described problem in which a screw is provided in the waste toner pipe such that the screw scrapes off the waste toner that has stuck to the inner wall of the waste toner pipe.

SUMMARY

An image forming apparatus according to an aspect of the present disclosure includes an image carrier, a first guide portion, a developing portion, and a second guide portion. The first guide portion forms a first flow path in which toner removed from the image carrier is flowed downward with respect to a horizontal direction. The developing portion visualizes an electrostatic latent image formed on a surface of the image carrier, with developer including at least toner and carrier. The second guide portion forms a second flow path in which the developer in the developing portion is flowed diagonally downward with respect to the horizontal direction and guided to the first flow path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 9 is a diagram showing the results of experiments conducted to investigate the presence/absence of a design problem and the clogging state of waste toner for various inclination angles of the pipe members 104 with respect to a horizontal plane.

DETAILED DESCRIPTION

The following describes an embodiment of an image forming apparatus according to the present disclosure with reference to the drawings. It should be noted that the following description is an example of a specific embodiment of the present disclosure and should not limit the technical scope of the disclosure.

Figure 1A:
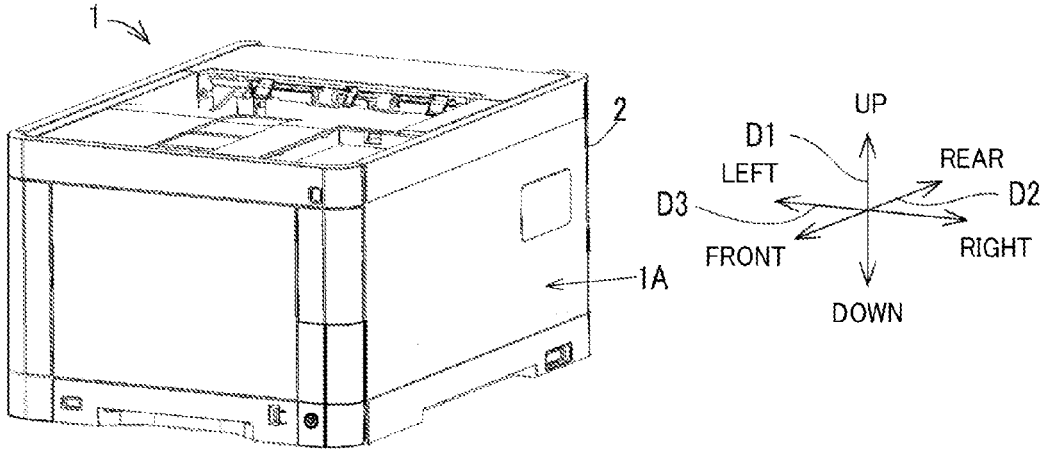
FIG. 1A is an outer appearance diagram of an image forming apparatus according to the present disclosure.

It is noted that the following description is given with use of an up-down direction D1, a front-rear direction D2, and a left-right direction D3 that are defined in FIG. 1A based on the normal use state of an image forming apparatus 1.

Figure 1B:
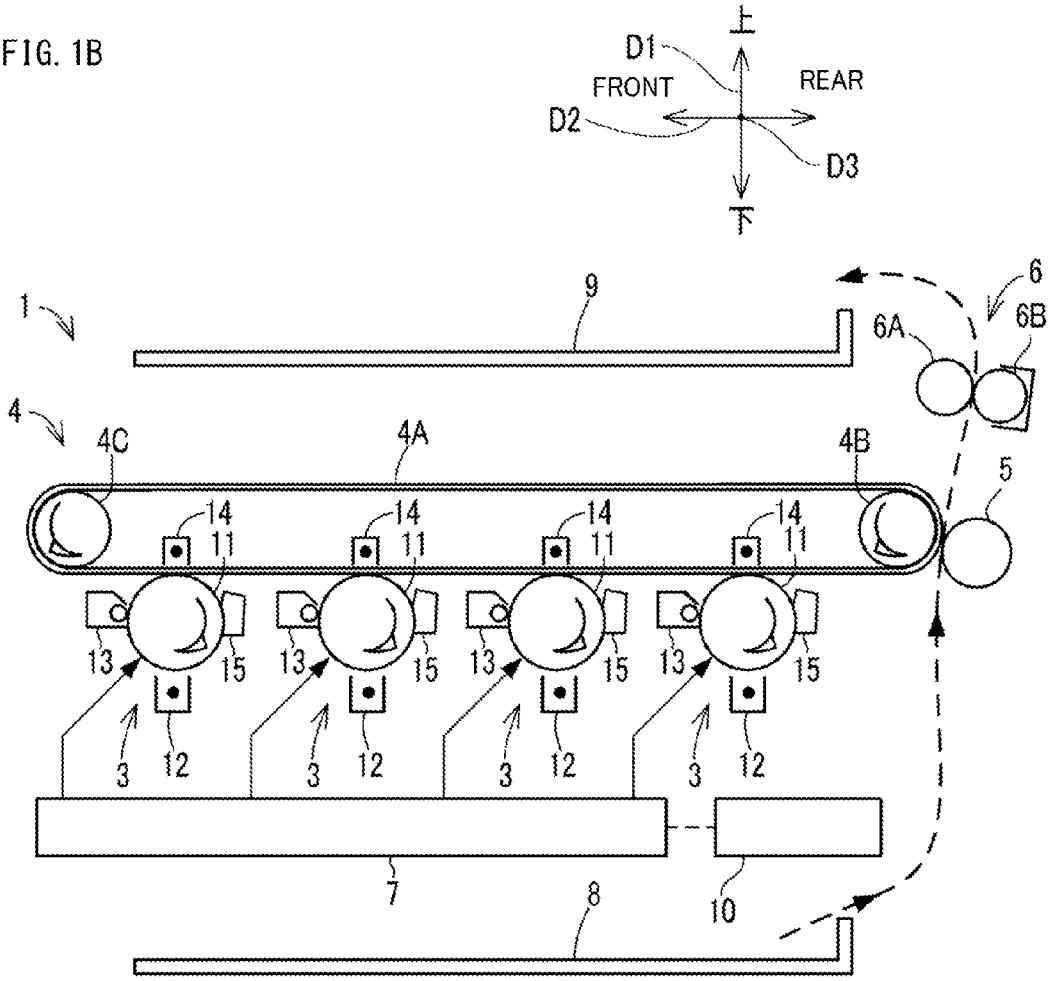
FIG. 1B is a schematic diagram showing the internal configuration of the image forming apparatus.

As shown in FIG. 1B, the image forming apparatus 1 is a so-called tandem color printer, and includes a plurality of image forming units 3, an intermediate transfer unit 4, a secondary transfer device 5, a fixing device 6, an exposure device 7, a sheet feed portion 8, a sheet discharge portion 9, and a control portion 10. As shown in FIG. 1A, the image forming apparatus 1 includes a housing 2 that includes a cover of an outer frame, and an inner frame.

The plurality of image forming units 3 are arranged in alignment in the front-rear direction D2. The plurality of image forming units 3 respectively form toner images of different colors. In FIG. 1B, an image forming unit 3 positioned on the most rear side forms a toner image by black toner, an image forming unit 3 positioned in front of it forms a toner image by yellow toner, an image forming unit 3 positioned in front of it forms a toner image by cyan toner, and an image forming unit 3 positioned on the most front side forms a toner image by magenta toner. Each of the image forming units 3 includes a photoconductor drum 11 (an example of the image carrier of the present disclosure), a charging device 12, a developing portion 13, a primary transfer device 14, and a cleaning portion 15.

The intermediate transfer unit 4 includes an intermediate transfer belt 4A, a driving roller 4B, and a driven roller 4C. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A passes through between the photoconductor drums 11 and the primary transfer devices 14, the toner images are transferred in sequence from the photoconductor drums 11 to a surface of the intermediate transfer belt 4A in such a way as to be overlaid with each other.

The secondary transfer device 5 transfers the toner image transferred on the intermediate transfer belt 4A, to a print sheet that is conveyed from the sheet feed portion 8. The print sheet with the toner image transferred thereon is conveyed to the fixing device 6. The fixing device 6 includes a heating roller 6A and a pressure roller 6B.

Figure 2:
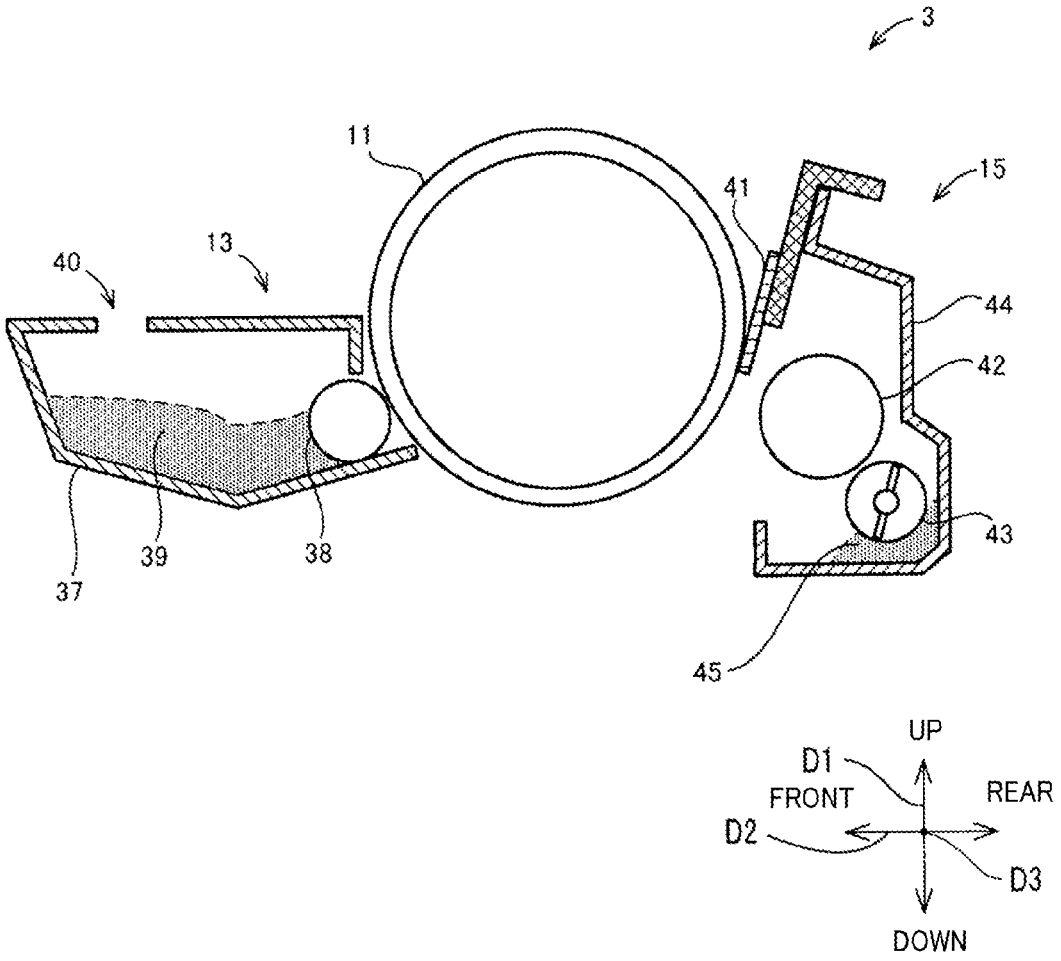
FIG. 2 is a cross section diagram showing the configuration of image forming units.
Figure 3:
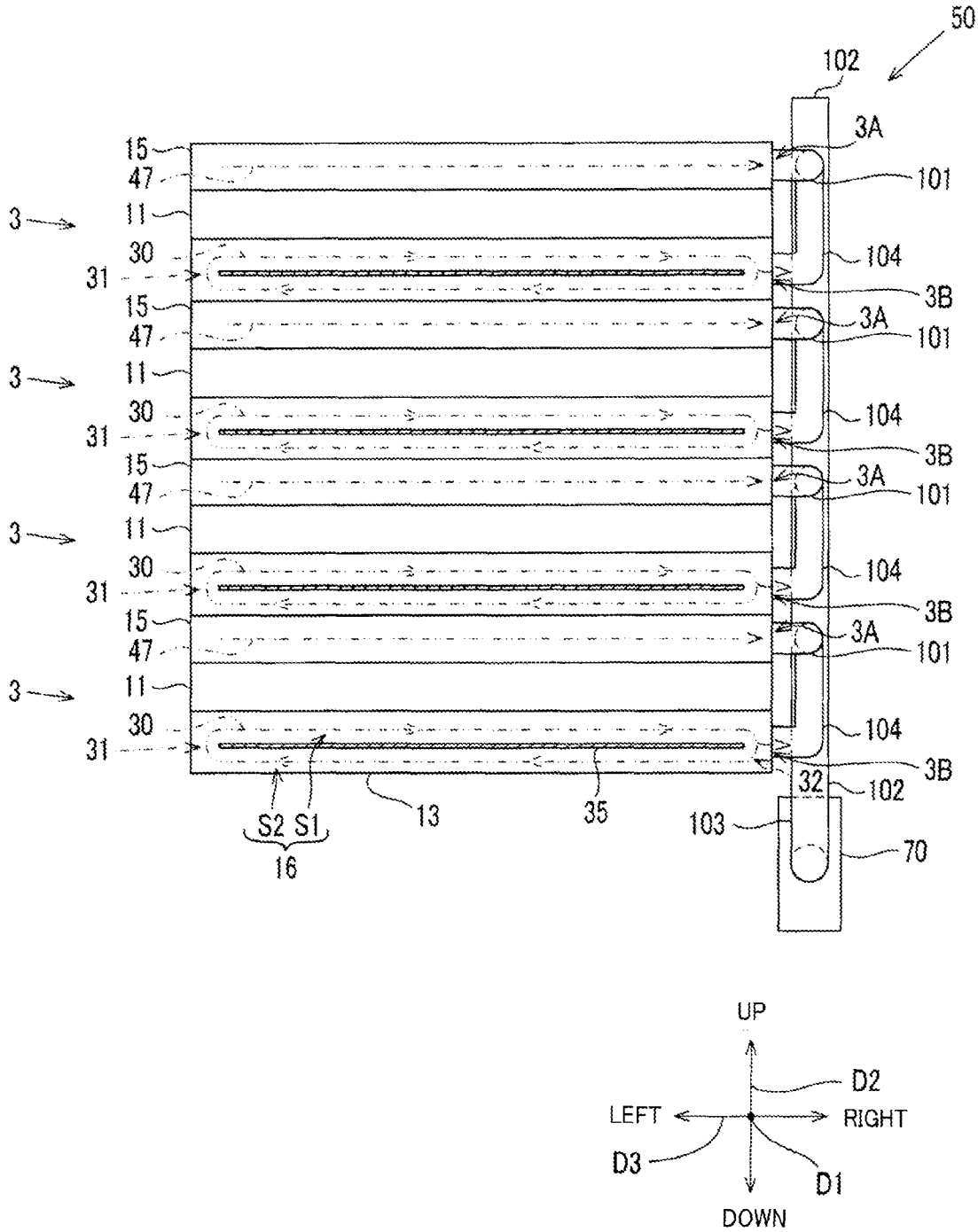
FIG. 3 is a diagram for explaining flow paths provided in the image forming units, wherein toner and the like removed from photoconductor drums by cleaning members flow in the flow paths until they are collected in a collection container.

FIG. 2 is a cross section diagram schematically showing the photoconductor drum 11, the developing portion 13, and the cleaning portion 15 in an image forming unit 3. As shown in FIG. 3, each image forming unit 3 includes the photoconductor drum 11, the developing portion 13, and the cleaning portion 15.

A bias having the same polarity as the charging polarity of the photoconductor drum 11 is applied to a magnet roller 38 of each developing portion 13. Toner 39 is charged by the magnet roller 38, and the charged toner 39 is flowed onto an electrostatic latent image on the surface of the photoconductor drum 11 so as to develop the electrostatic latent image. The toner 39 is supplied from a toner container (not shown) via a toner supply port 40. The developing portions 13 corresponds to the developing portion of the present disclosure.

The cleaning unit 15 includes a cleaning blade 41 that is a cleaning member, a cleaning roller 42, a first screw member 43, and a toner box 44. Waste toner 45 removed by the cleaning blade 41 is taken into the toner box 44 by the action of gravity or by the rotation of the cleaning roller 42. The waste toner 45 taken into the toner box 44 is conveyed by the first screw member 43. A discharge port (not shown) is formed in the right side wall of the toner box 44. The first screw member 43 has a helical blade around a shaft body. The waste toner conveyed by the first screw member 43 is conveyed to the discharge port. The cleaning portion 15 corresponds to the cleaning portion of the present disclosure.

Each pair of the photoconductor drum 11 and the cleaning portion 15 is unitized as a drum unit 17. A plurality of discharge ports 3A are formed in end portions of housings (not shown) of the drum units 17 (see FIG. 3). The discharge ports 3A respectively communicate with the discharge ports (not shown) that are formed in the right side walls of the toner boxes 44.

FIG. 3 is a diagram for explaining flow paths in the image forming units 3, wherein toner and the like removed from the photoconductor drums 11 by the cleaning blades 41 and the cleaning rollers 42 flow in the flow paths until they are collected in a collection container 70 that is described below. As shown in FIG. 3, the toner removed by the cleaning members is conveyed as waste toner from left to right in conveyance paths 47 that extend in the left-right direction D3 in the image forming apparatus 1. The waste toner that has flowed to the right end of the image forming units 3 is discharged from the discharge ports 3A provided at the right end of the drum units 17, to a developer conveying portion 50 that is described below.

Each developing portion 13 visualizes, with developer, an electrostatic latent image formed on the surface of the photoconductor drum 11. As the developer, a two-component developer composed of toner and carrier is used. The toner is made of resin and the carrier is made of a magnetic material. Toner is smaller than carrier in particle size. As a result, toner is smaller than carrier in weight. In addition, an external additive is added to the developer. The carrier is magnetic particles composed of ferrite and the like. When a mixture of carrier and toner is stirred, toner is charged with static electricity that is generated by the friction between the toner and the carrier. With the presence of carrier, the two-component developer allows toner to be more easily charged than the one-component developer that is composed of only toner, thereby a high-quality image is made possible.

Among toner and carrier that compose the two-component developer, the toner is consumed in the image formation process. As a result, toner is supplied to the developing portions 13 from a tank (not shown) to supplement the consumed amount of toner. On the other hand, the carrier remains in the developing portions 13 without being consumed, and gives fluidity and the like to the toner that is newly supplied to the developing portions 13. In this way, carrier is used for a longer period than toner. When carrier is used for a long period and stirred many times, the resin coat layer formed on the surface of carrier particles may peel off, or toner particles may stick to the surface of carrier particles. Due to such phenomena, carrier is deteriorated and its performance of giving the fluidity or the like is degraded.

In addition, each developing portion 13 causes a second screw member 120 (see FIG. 4) to stir the two-component developer so as to charge the toner sufficiently. The second screw member 120 includes a helical blade around the shaft body. When the two-component developer remains in the developing portions 13 for a long period, toner particles change in shape and size due to friction between toner particles caused by the stirring operation in the developing portions 13, and toner is deteriorated since the charging characteristic of toner changes. When an image is formed using such deteriorated toner, the charged amount of toner is reduced and fogging of toner or the like is likely to occur, which leads to degradation of image quality.

In the present embodiment, to avoid such a problem, a developing device of a so-called trickle development system is adopted, wherein in the trickle development system, old two-component developer is gradually discarded, and new two-component developer is gradually supplied. Hereinafter, the two-component developer that is discarded as such is referred to as waste developer. As described below, the waste developer is collected in the collection container 70 (see FIG. 3) together with the waste toner that has been removed from the surface of the photoconductor drums 11.

Figure 4:
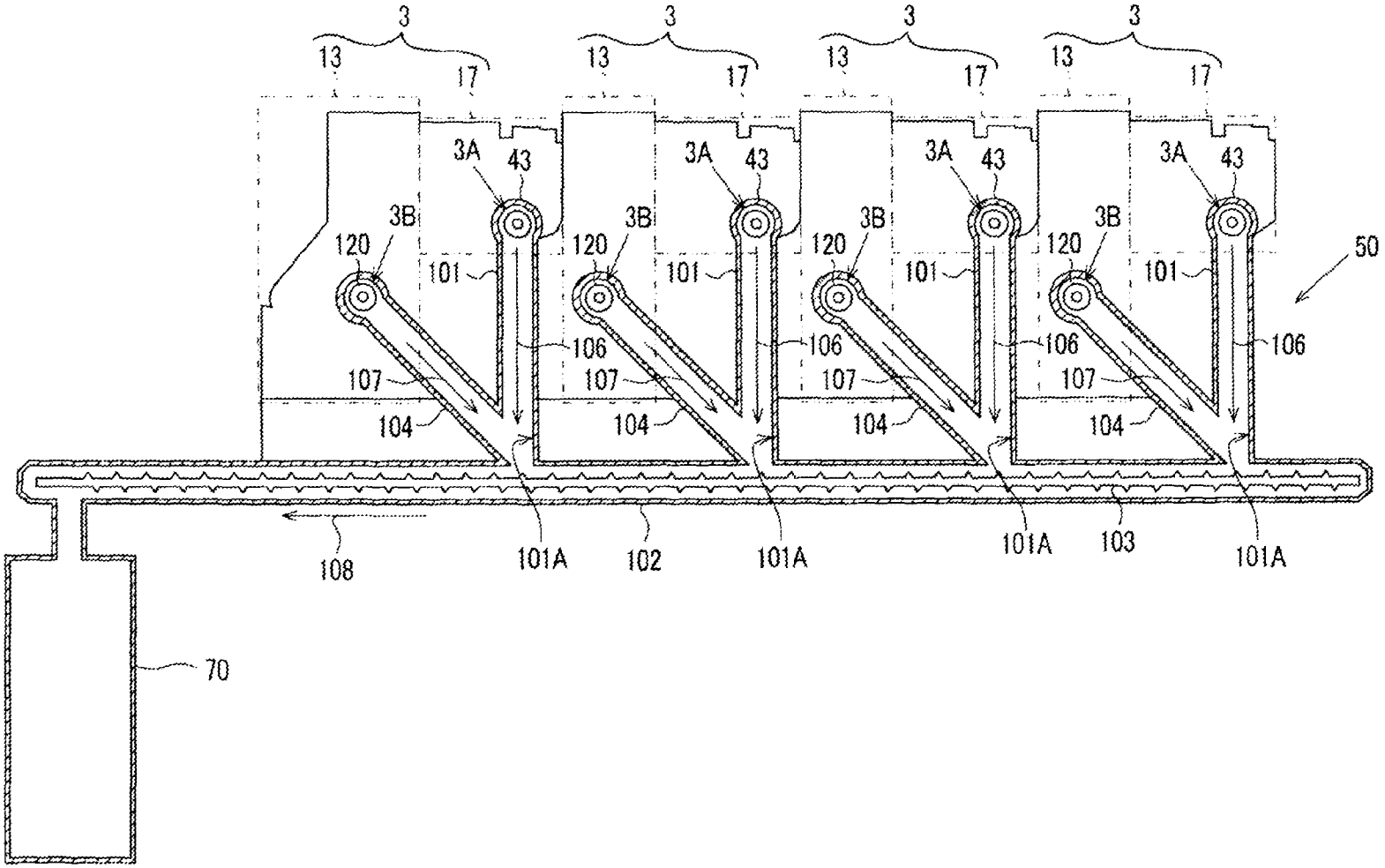
FIG. 4 is a diagram showing the configuration of a developer conveying portion.

Each developing portion 13 of the trickle development system includes a developer storage portion 16 (see FIG. 3) for storing the two-component developer. The developer storage portion 16 includes a partition wall 35 that is erected on a bottom surface (not shown) thereof along the axis direction. The inner space of the developer storage portion 16 is partitioned into two spaces S1 and S2 by the partition wall 35. The two spaces S1 and S2 communicate with each other at opposite ends thereof (see arrows 31 and 32). In addition, the second screw member 120 is provided in each of the two spaces S1 and S2. It is noted that FIG. 4 shows only a second screw member 120 in one of the two spaces. With the rotation of these second screw members 120, a circulation path 30 is formed such that the two-component developer circulates in the spaces S1 and S2 of the developer storage portion 16.

In the right end portions of the developing cases 37 of the developing portions 13, a plurality of discharge ports 3B (see FIG. 3, FIG. 4) are provided such that the two-component developer is discharged from the developing portions 13 to the developer conveying portion 50 that is described below. Part of the circulating two-component developer is discharged as the waste developer, to the developer conveying portion 50 from the discharge ports 3B.

The image forming apparatus 1 includes the developer conveying portion 50. The developer conveying portion 50 conveys, to the collection container 70, the waste toner discharged from the cleaning portions 15 of the image forming units 3, and the waste developer discharged from the developing portions 13. As shown in FIG. 4, the developer conveying portion 50 includes pipe members 101 and a pipe member 102.

As shown in FIG. 3 and FIG. 4, a pipe member 101 is provided for each cleaning portion 15. The pipe members 101 are respectively connected to the discharge outlets 3A and extend downward. In the present embodiment, the pipe members 101 extend downward in the vertical direction. As a result, the waste toner that has reached the discharge outlets 3A falls in (passes through) the pipe members 101. In this way, the pipe members 101 form first flow paths 106 (see FIG. 4) in which the waste toner removed from the photoconductor drums 11 flows downward. The pipe members 101 are an example of the first guide portion of the present disclosure.

The pipe member 102 extends in the horizontal direction along a right side wall 1A (see FIG. 1A) in such a way as to face the image forming units 3. The pipe member 102 is connected to the lower end portions of the pipe members 101, intersecting the pipe members 101. In the present embodiment, the pipe member 102 orthogonally intersects the pipe members 101. The waste toner is supplied to the pipe member 102 from the pipe members 101.

The collection container 70 is connected to one end portion of the pipe member 102. A third screw member 103 is provided in the pipe member 102. The third screw member 103 has a helical blade around a shaft body. The third screw member 103 is rotationally driven by a driving motor (not shown) and thereby conveys the waste toner that has been supplied to the pipe member 102 to the collection container 70. In this way, the pipe member 102 forms a third flow path 108 that intersects the lower end portions of the pipe members 101 (the first flow paths 106). The pipe member 102 is an example of the third guide portion of the present disclosure.

Meanwhile, the fluidity of the waste toner is reduced when, for example, the external additive is buried in the toner due to a stress which it receives when, for example, it is sandwiched among the cleaning blade 41 that is a cleaning member, the cleaning roller 42, and the photoconductor drum 11. The waste toner with reduced fluidity is likely to stick to inner walls 101A of the pipe members 101. Once waste toner sticks to the inner wall 101A, part of newly fallen waste toner sticks to the waste toner that has stuck to the inner wall. This goes on and on and results in a relatively large accumulation of waste toner. Such a large accumulation would clog the connection parts of the pipe members 101 and the pipe member 102.

In addition, in the above-described configuration where the waste toner is supplied to the pipe member 102 from a plurality of pipe members 101, there may be a case where the waste toner that is present in the pipe member 102 becomes bulky. In that case, the waste toner that has fallen in the pipe members 101 may accumulate on the waste toner that is present in the pipe member 102, and the accumulation of the waste toner may reach the inside of a pipe member 101 and the waste toner may stick to the inner wall 101A of the pipe member 101 at the peripheral of the connection part of the pipe member 102 and the pipe member 101. This allows an accumulation of waste toner to be generated in the connection part (see the leftmost arrow 150 among the arrows 150 in FIG. 5). The accumulation causes a clog in the connection part.

If the pipe diameter of the pipe member 102 is made larger, the waste toner present in the pipe member 102 will become less bulky, and the waste toner in the pipe member 102 will not or rarely reach the inside of the pipe members 101. In that way, the generation of the accumulation at the connection part will be prevented, and the clog of the waste toner will be prevented or restricted. However, in view of the demand for the miniaturization of the image forming apparatus in recent years, the method is not preferable since the apparatus will be larger in size if the pipe diameter is made larger, which is against the demand for the miniturization.

There is known a configuration for solving the above-described problem in which a screw member is provided in each pipe member 101 such that the screw member scrapes off the waste toner that has stuck to the inner wall 101A of the pipe member 101. However, providing the screw members will make the configuration complicated and increase the number of parts. In addition, it will increase the cost. With these taken into account, the following configuration is adopted in the present embodiment.

As shown in FIG. 4, the developer conveying portion 50 includes pipe members 104. The pipe members 104 are respectively provided in the developing portions 13. The pipe members 104 are respectively connected to the discharge ports 3B. The pipe members 104 intersect the pipe members 101 in the state of being inclined downward with respect to the horizontal direction. In the present embodiment, the pipe members 104 intersect and connect to the lower end portions of the pipe members 101. The pipe members 104 form second flow paths 107 in which the waste developer in the developing portions 13 is flowed diagonally downward with respect to the horizontal direction and guided to the lower end portions of the first flow paths 106. The pipe members 104 are an example of the second guide portion of the present disclosure.

FIG. 9 is a diagram showing the results of experiments conducted to investigate the presence/absence of a design problem and the clogging state of waste toner for various inclination angles of the pipe members 104 with respect to a horizontal plane. In the experiment, the inclination angle was set at an interval of 20° to 10° in the inclination angle range of 20° to 90°. In FIG. 9, with regard to the design problem, the sign "○" indicates that there is no design problem. In addition, the sign "×" indicates that there is a design problem and so the developer conveying portion 50 cannot be manufactured. As shown in FIG. 9, there is no design problem except for the case where the inclination angle is 90°.

Furthermore, an experiment was conducted to investigate the clogging state of waste toner for the inclination angles other than 90° at which there is no design problem, and the results shown in FIG. 9 were obtained. The double circle sign indicates that there is no clog of waste toner. The sign "○" indicates that there is almost no clog of waste toner. The sign "Δ" (triangle) indicates that a clog of waste toner occurs. The sign "×" indicates that a serious clog of waste toner occurs. As shown in FIG. 9, the pipe members 104 are preferably inclined 50° to 80° with respect to the horizontal plane, and the most preferable inclination angle is 80°.

Next, the act of the present embodiment is described.

Figure 5:
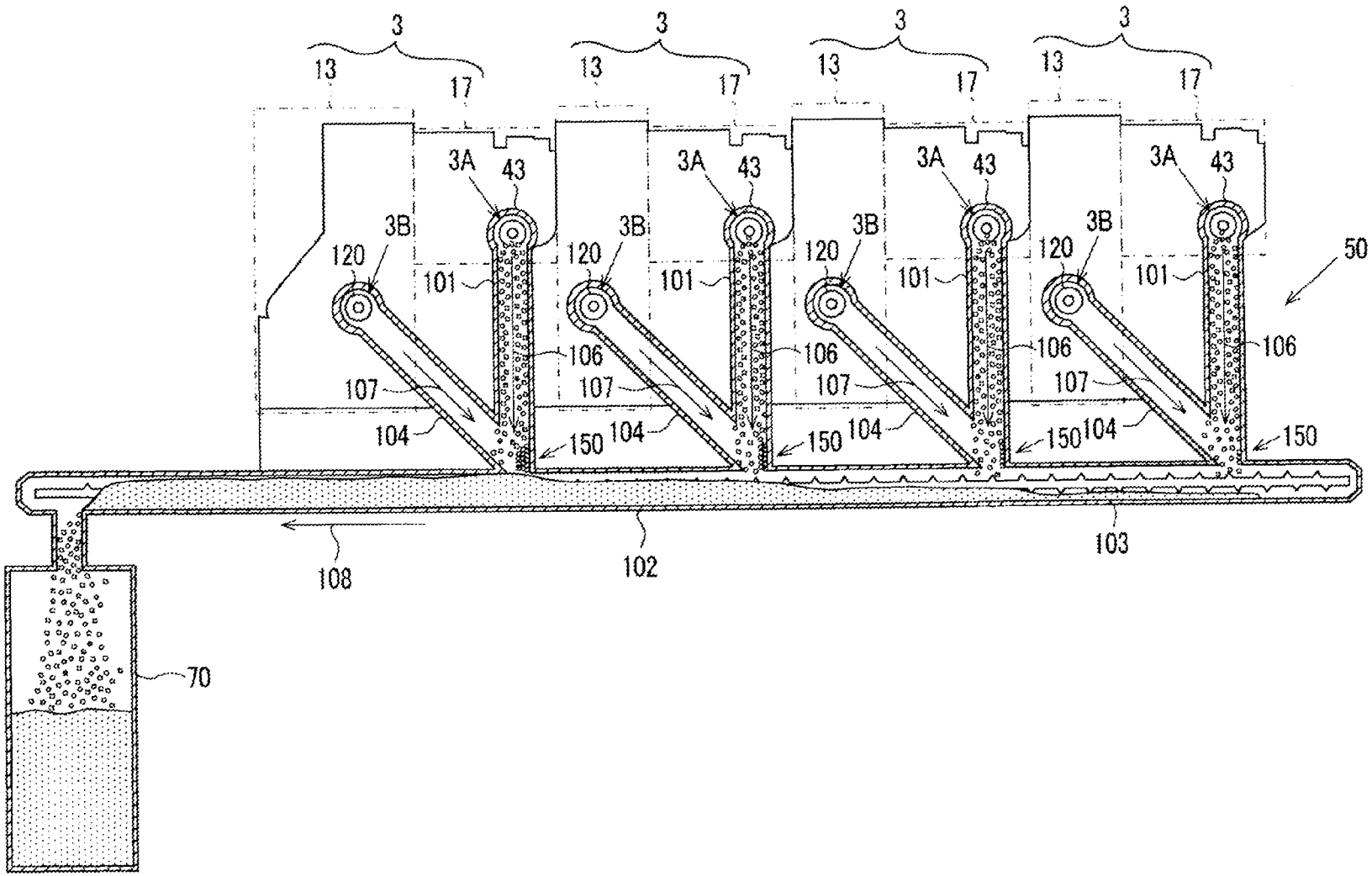
FIG. 5 is a diagram for explaining a problem to be solved.

Here, it is supposed that, as indicated by the arrow 150 in FIG. 5, waste toner has stuck to the inner walls 101A at the peripheral of the connection parts of the pipe members 101 and the pipe member 102. It is noted that, as described above, the image forming apparatus 1 of the present embodiment is a tandem image forming apparatus and a more amount of developer is present as it is positioned more on the downstream side in the pipe member 102. As a result, FIG. 5 shows that the accumulation that is formed at the connection part between each pipe member 101 and the pipe member 102 is larger as it is positioned more on the downstream side.

Figure 6:
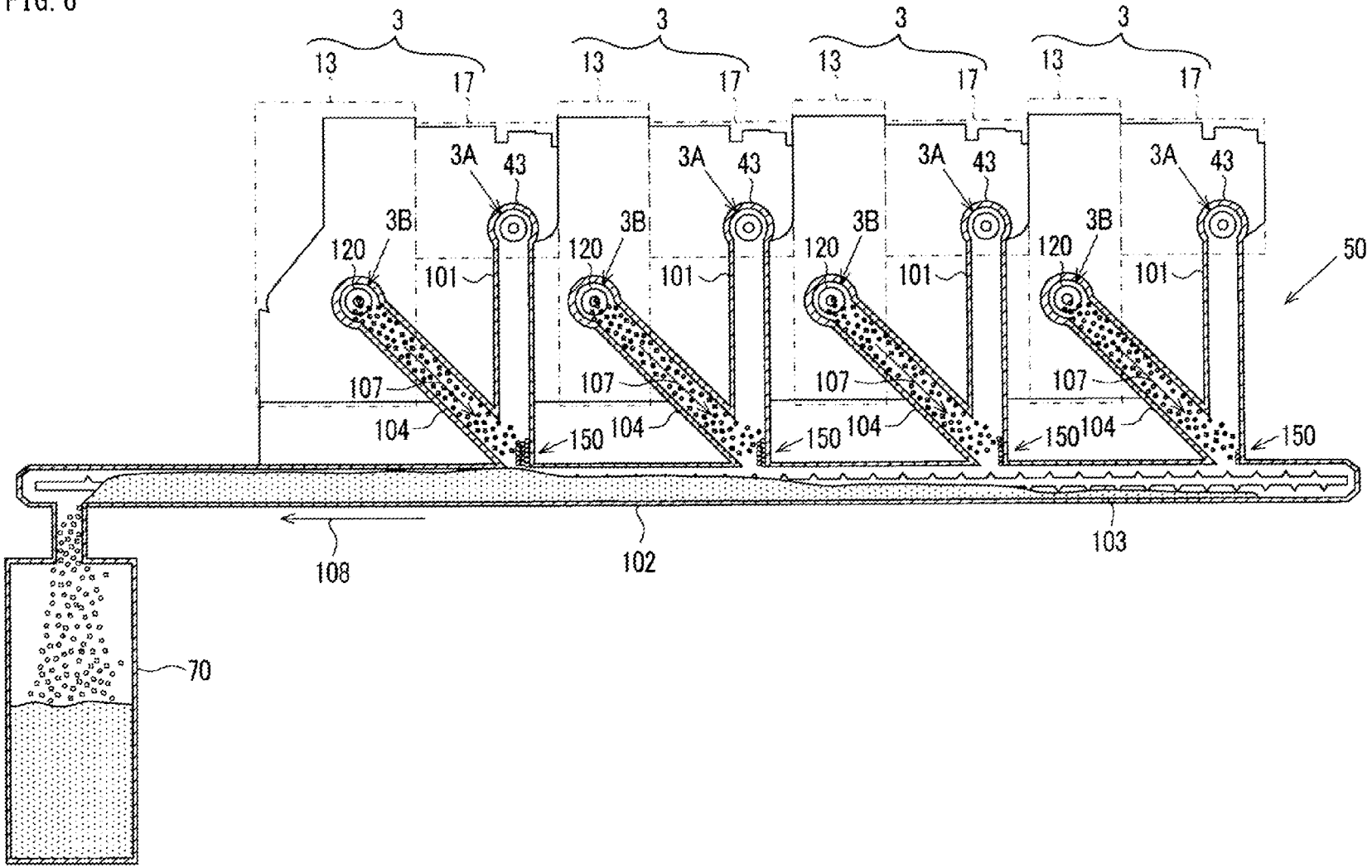
FIG. 6 is a diagram for explaining the act of the developer conveying portion shown in FIG. 4.

When the waste developer of the developing portions 13 is discharged from the discharge ports 3B in the above-described state (see FIG. 6), the waste developer flows down in the pipe members 104 toward the connection parts between the pipe members 101 and the pipe member 102. Subsequently, the waste developer collides with the accumulations of the waste toner that have been generated in the connection parts.

Figure 7:
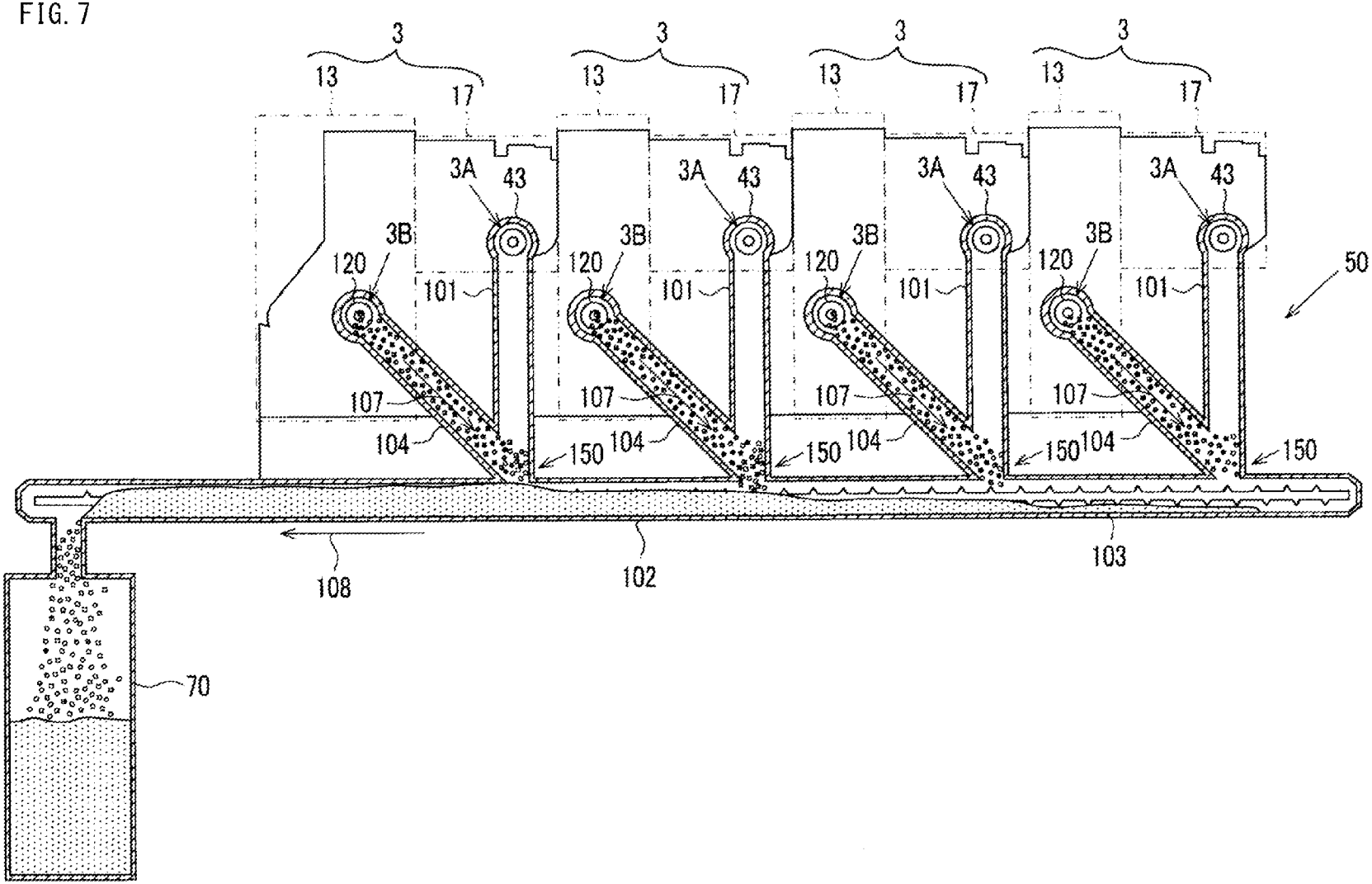
FIG. 7 is a diagram for explaining the act of the developer conveying portion shown in FIG. 4.

Here, the waste developer that flows down in the pipe members 104 includes the carrier, and thus has a larger mass per unit volume than the waste toner. Furthermore, the waste developer has higher fluidity than the waste toner that passes through the pipe members 101. Thus the waste developer has a relatively large kinetic energy when it collides with the accumulation. As a result, when the waste developer collides with the accumulation of the waste toner, a relatively large energy is applied to the accumulation. This allows the accumulation of the waste toner to collapse as shown in FIG. 7. As a result, the configuration makes it possible to prevent the waste toner from clogging the connection parts of the pipe members 101 and the pipe member 102.

As described above, in the present embodiment, the kinetic energy of the waste developer discharged from the developing portions 13 is used to collapse the accumulation of the waste toner. Compared to the conventional configuration where the screw is used to collapse the accumulation of the waste toner, the configuration of the present embodiment makes it possible to prevent the waste toner from clogging and, at the same time, restrict the configuration from becoming complicated and the number of parts from increasing.

Up to now, a preferable embodiment of the present disclosure has been described. However, the present disclosure is not limited to the embodiment described so far, but is applicable to various modifications.

Figure 8:
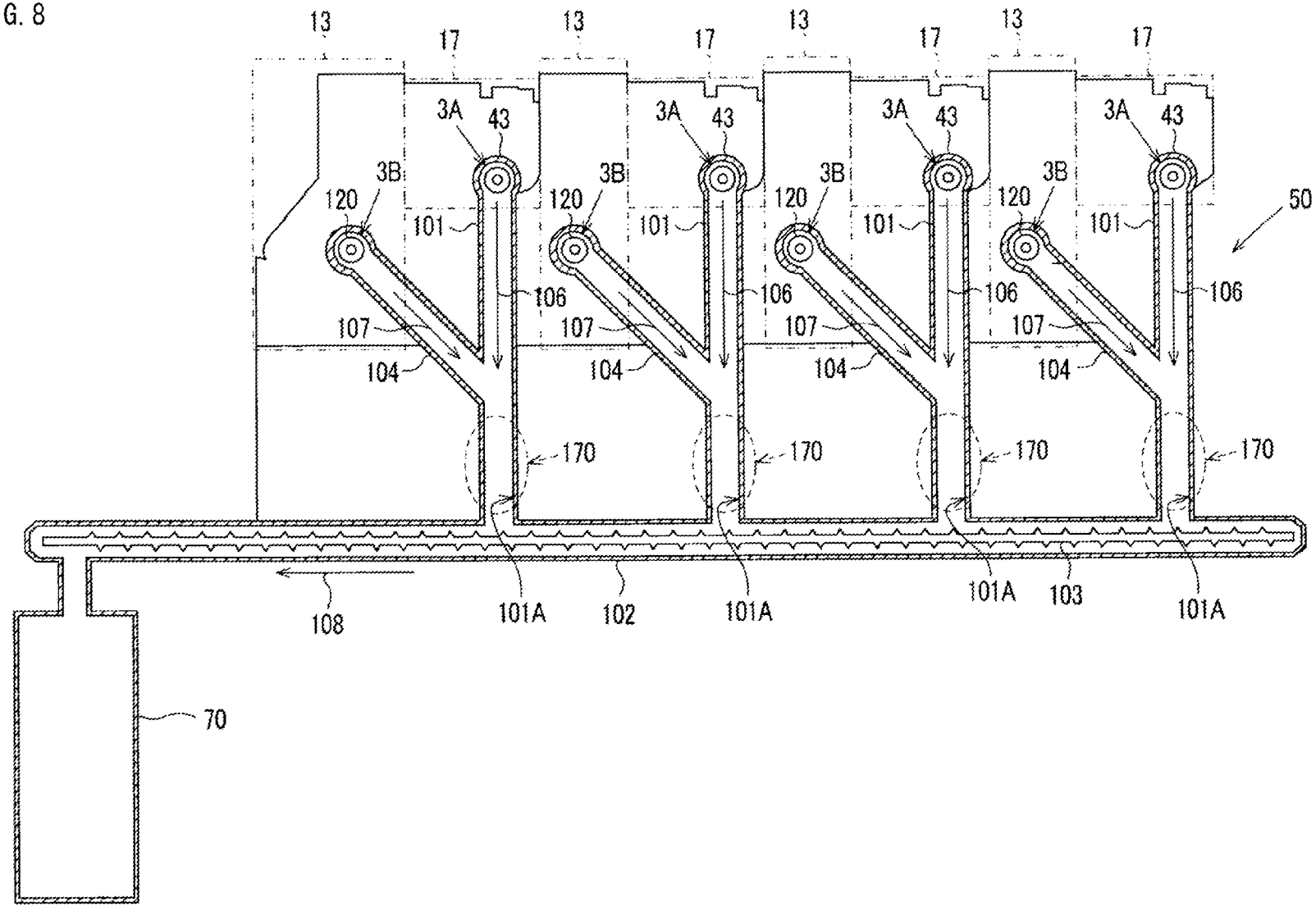
FIG. 8 is a diagram showing a modification of the developer conveying portion.

In the above-described embodiment, the waste developer is caused to flow down directly to the connection parts of the pipe members 101 and the pipe member 102 where the accumulations of the waste toner are likely to occur. However, the present disclosure is not limited to this configuration. For example, in the case where the pipe members 101 are relatively long, the pipe members 104 may be arranged to connect (merge) with the pipe members 101 at a position that is more on the upstream side than the connection parts of the pipe members 101 and the pipe member 102, as indicated by the arrow 170 in FIG. 8, for example, at a middle position of each pipe member 101.

Figure 10A:
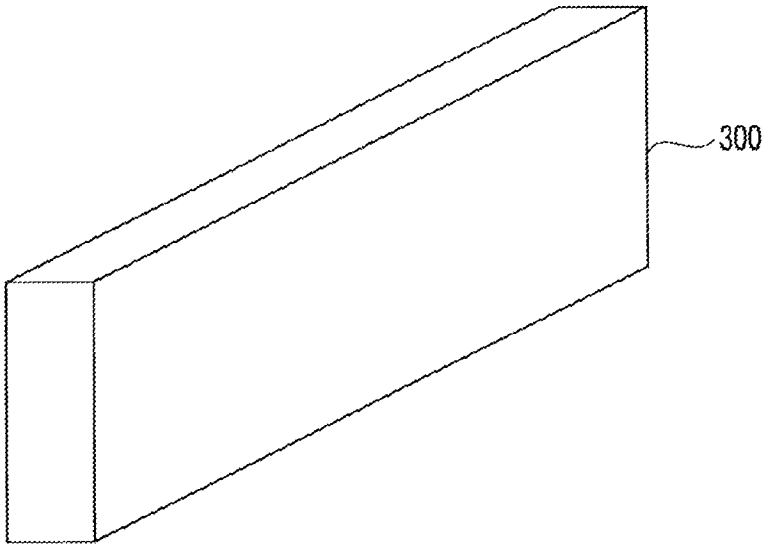
FIG. 10A-FIG. 10C show another modification of the developer conveying portion.
Figure 10C:
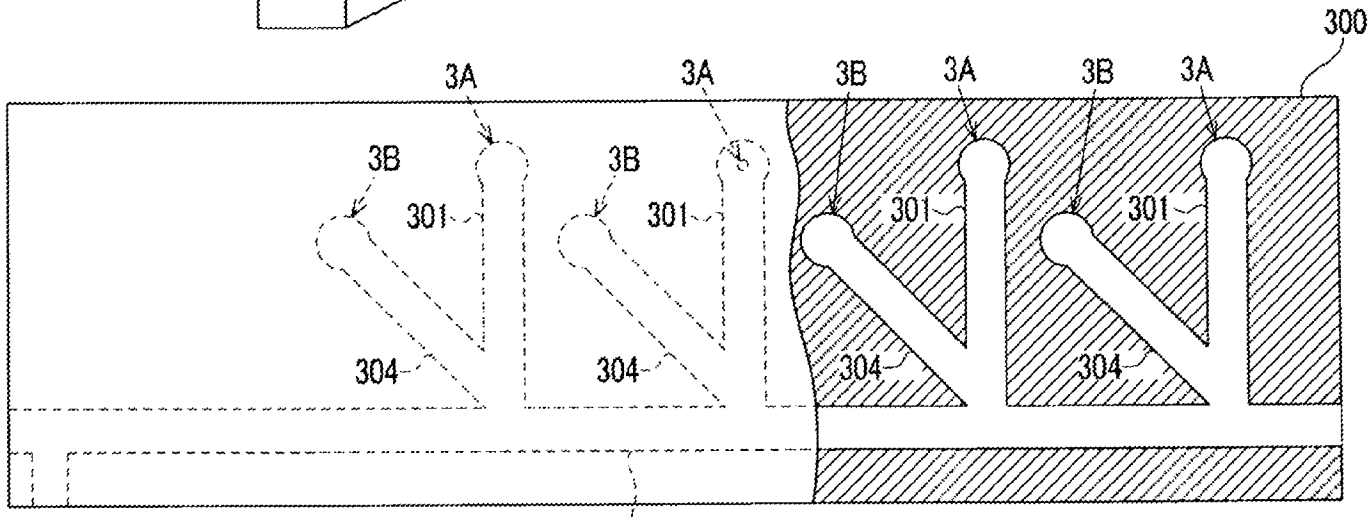
Figure 10B:
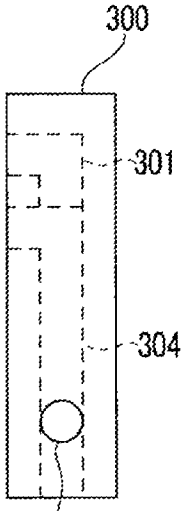

In the above-described embodiment, the first flow paths 106, the third flow path 108, and the second flow paths 107 are formed in the pipe members 101, the pipe member 102, and the pipe members 104, respectively. However, the present disclosure is not limited to this configuration. For example, FIG. 10A-FIG. 10C show an adoptable configuration where hole portions 301, a hole portion 302, and hole portions 304 respectively forming the first flow paths 106, the third flow path 108, and the second flow paths 107 are provided in a block body 300. The block body 300 is disposed at the developer conveying portion 50 of the above-described embodiment, along the right side wall 1A of the image forming apparatus 1.

In the above-described embodiment, the developer includes the external additive. However, the developer does not necessarily include the external additive. The developer not including the external additive has lower fluidity than the developer including the external additive. However, since the developer includes the carrier, the developer has a larger mass per unit volume than the waste toner. As a result, in this case, too, it is possible to cause the developer having a relatively large kinetic energy to collide with the accumulation of the waste toner. As a result, it is possible to collapse the accumulation of the waste toner.

In another embodiment of the present disclosure, in the image forming apparatus 1, the control portion 10 controls the rotation operation (stirring operation) of the second screw member 120 in such a way as to guide the developer in the developing portions 13 from the discharge ports 3B to the pipe members 101 (first guide portion) via the pipe members 104 (second guide portion). For example, the control portion 10 counts the number of printed sheets in the image forming apparatus 1 by using an internal counter or the like, and each time it counts 5,000 sheets, the control portion 10 changes the rotation operation of the second screw member 120 such that the developer is guided from the developing portions 13 to the first flow paths 106 of the pipe members 101 via the pipe members 104. Specifically, the control portion 10 rotationally drives the second screw member 120 at such a low speed as to refrain the developer from being discharged from the discharge ports 3B until 5,000 sheets are counted, and after 5,000 sheets are counted, the control portion 10 rotationally drives the second screw member 120 at a high speed higher than the low speed so as to positively discharge the developer from the discharge ports 3B. In that case, the amount of developer conveyed to the discharge ports 3B is increased, and the developer collected inside the discharge ports 3B is overflowingly discharged from the discharge ports 3B to the pipe members 104. After rotationally driving the second screw member 120 at a high speed for a predetermined time period, the control portion 10 rotationally drives the second screw member 120 at a low speed until 5,000 sheets are counted again. It is noted that the configuration may be modified such that, when the second screw member 120 is rotationally driven at a low speed, the developer may not be discharged at all from the discharge ports 3B, or the configuration may be modified such that a small amount of developer may be continuously discharged from the discharge ports 3B.

Here, the toner consumption per printed sheet output in a general office work is 10-15 mg. Thus the total toner consumption for 5,000 printed sheets is 75 g (=15 mg×5,000 sheets). Since the average transfer efficiency in the developing portions 13 is approximately 90%, the amount of waste toner collected by the cleaning portions 15 is 7.5 g (75 g×0.1). It is known empirically that, in the case where 7.5 g of waste toner is collected by the cleaning portions 15 and discharged to the pipe members 101, it is highly possible that the waste toner accumulates in the connection parts shown in FIG. 6 (the parts indicated by the arrows 150). It is thus preferable that, as described above, each time 5,000 printed sheets are counted, the control portion 10 rotationally drives the second screw member 120 such that the developer in the developing portions 13 is guided from the pipe members 104 to the pipe members 101. It is noted that since the specific gravity of the toner is approximately 1.2 ($g/cm^3$) and the specific gravity of the developer is approximately 4.5 ($g/cm^3$), the developer guided to the pipe members 101 can effectively remove the accumulation of waste toner, thereby preventing the connection parts from being clogged.

In the above-described embodiment, the pipe members 101 extend downward in the vertical direction. However, the pipe members 101 do not necessarily extend downward in the vertical direction. The present disclosure includes an embodiment in which the pipe members 101 are inclined. In addition, the application target of the present disclosure includes a configuration in which the pipe member 102 are not provided. Furthermore, in the above-described embodiment, the image forming apparatus 1 is a tandem type. However, the present disclosure is not limited to a tandem image forming apparatus, but is applicable to a monochrome image forming apparatus as well.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrier;

a developing portion configured to visualize an electrostatic latent image formed on a surface of the image carrier, with developer including at least toner and carrier;

a cleaning portion configured to remove toner that has stuck to the image carrier after developing by the developing portion, and discharge the removed toner from a discharge port;

a first guide portion configured to form a first flow path in which the toner discharged from the discharge port by the cleaning portion is flowed downward in a vertical direction with respect to a horizontal direction by action of gravity, the first guide portion extending downward in the vertical direction from the discharge port and being formed from a first pipe member;

a second guide portion configured to form a second flow path in which the developer in the developing portion is flowed diagonally downward with respect to the horizontal direction by the action of gravity and guided to the first flow path, the second guide portion being inclined diagonally downward with respect to the horizontal direction at an inclination angle of 50° or more and 80° or less and being formed from a second pipe member;

a third guide portion configured to form a third flow path which intersects a lower end portion of the first flow path and in which the toner that has been flowed downward in the vertical direction in the first flow path is flowed in the horizontal direction; and a conveyance member provided in the third flow path and configured to convey the toner that has entered the third flow path to a predetermined collection container along the third flow path, wherein the second guide portion is directly connected to the lower end portion of the first flow path and guides the developer to the lower end portion of the first flow path, the first guide portion includes an inner wall at a periphery of a connection part of the first guide portion and the third guide portion, the inner wall facing the second guide portion, and the first guide portion and the second guide portion are arranged such that the developer flowing down in the second flow path of the second guide portion toward the connection part collides with the inner wall and enters the third flow path of the third guide portion via the connection part.

2. The image forming apparatus according to claim 1 further comprising:

a control portion configured to control the developing portion in such a way as to control an operation of discharging the developer in the developing portion to the second guide portion, wherein the control portion discharges the developer to the second guide portion each time a predetermined number of printed sheets is counted.

3. The image forming apparatus according to claim 1, wherein the third guide portion is formed from a third pipe member and has approximately a same diameter as the first guide portion and the second guide portion.

* * * * *